United States Patent [19]

Cannon, Jr.

[11] 4,099,470

[45] Jul. 11, 1978

[54] CARD TABLE ATTACHMENT

[76] Inventor: Thomas C. Cannon, Jr., 5244 Lake Springs Dr., Dunwoody, Ga. 30338

[21] Appl. No.: 724,598

[22] Filed: Sep. 17, 1976

[51] Int. Cl.[2] ..... A47B 97/00

[52] U.S. Cl. ..... 108/26; 108/97; 108/152; 248/311.1 R

[58] Field of Search ..... 108/26, 27, 93, 152, 108/65, 67–69, 97, 161; 248/311.1

[56] References Cited

U.S. PATENT DOCUMENTS

| | | | |
|---|---|---|---|
| 501,204 | 7/1893 | Crane | 273/96 R |
| 581,681 | 4/1897 | Shauer | 108/26 X |
| 775,070 | 11/1904 | Spurlin | 108/93 |
| 1,397,782 | 11/1921 | Rhodes | 108/93 |
| 1,937,994 | 12/1933 | Taylor | 108/26 |
| 2,008,078 | 7/1935 | Martin | 108/93 X |
| 2,061,143 | 11/1936 | De St. Mart | 108/93 |
| 2,185,907 | 1/1940 | Alexander | 108/26 |
| 2,541,779 | 2/1951 | Reeves | 108/93 |
| 2,707,141 | 4/1965 | Witter | 108/26 |
| 2,754,167 | 7/1956 | Young | 108/26 X |
| 3,314,635 | 4/1967 | Frye | 248/311.1 |
| 3,638,587 | 2/1972 | Uyeda et al. | 108/97 X |
| 3,643,951 | 2/1972 | Breslow | 273/108 |

*Primary Examiner*—Roy D. Frazier
*Assistant Examiner*—William E. Lyddane
*Attorney, Agent, or Firm*—Martha G. Pugh

[57] ABSTRACT

A device for attachment to a foldable card table, or the like, providing a convenient horizontal surface for drinks, snacks, etc., which is out of the way of the normal table playing surface. The attachement includes a rigid tongue which is designed to be interposed between the table top and the frame, and which serves to support a tray extending out from the edge of the table, preferably at the corner. One embodiment comprises a one-piece attachment having a rectangular tongue at one end, and providing an elliptical or semicircular tray surface at the other end, with a raised edge around the external periphery of the latter. In one variation, a slit on the inner edge of the tongue is designed to accommodate obstacles, such as bolts, between the top and frame at the table corner. In other embodiments, the tray is hinged to the external end of the tongue; and the tray portion is designed to fit over the table corner for storage purposes.

14 Claims, 12 Drawing Figures

FIG. 4
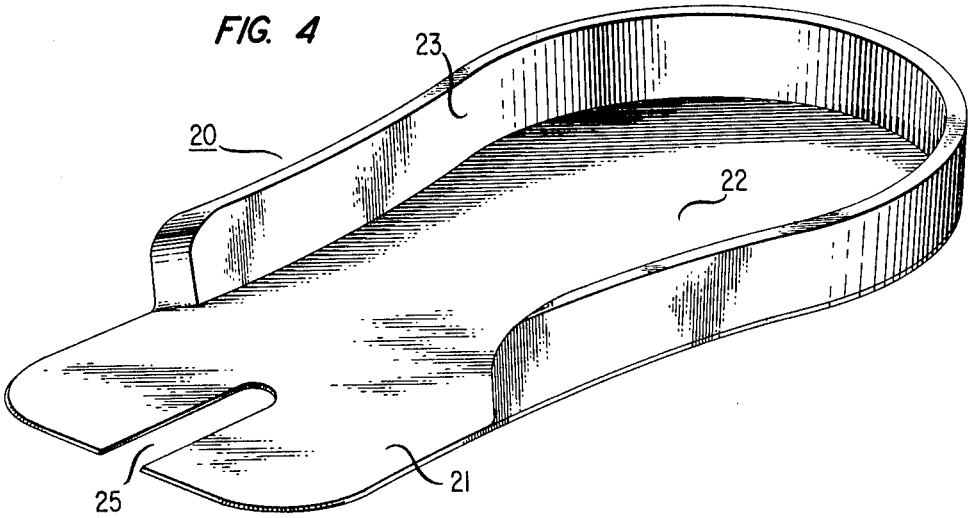
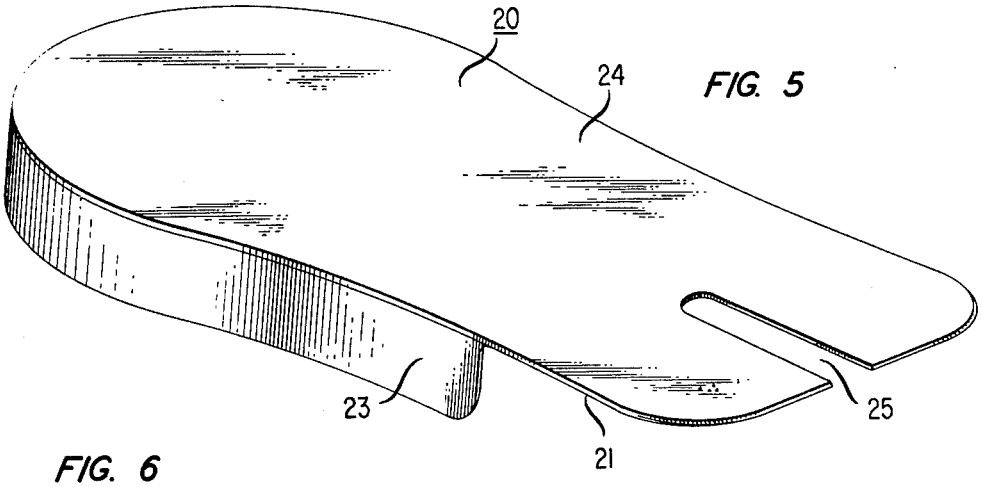
FIG. 5
FIG. 6
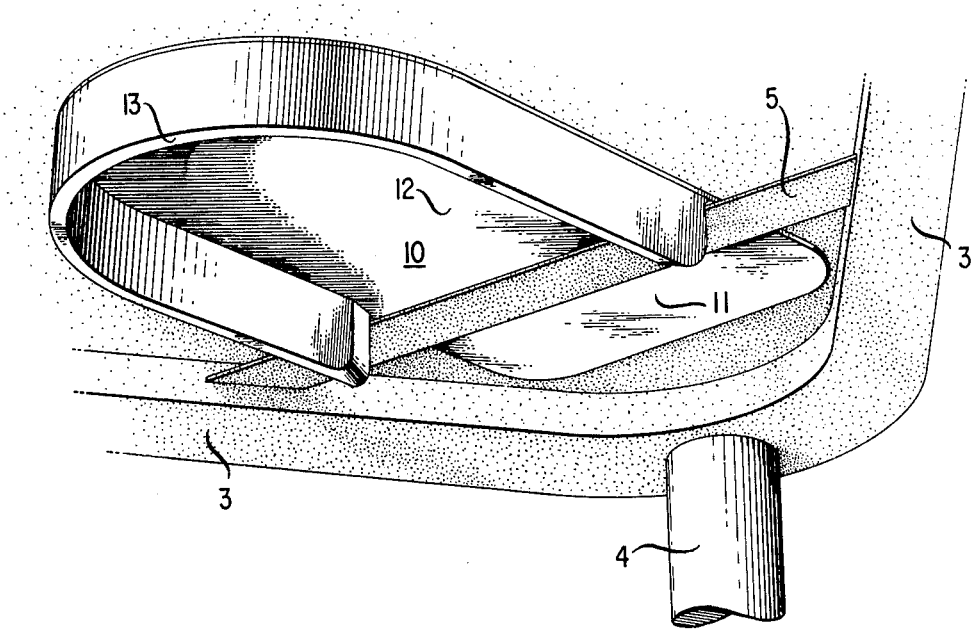

CARD TABLE ATTACHMENT

BACKGROUND OF THE INVENTION

This relates in general to auxiliary trays for attachment to folding game tables and the like.

When a number of persons are seated at a game or conference table, a problem arises in the placement of drinks or snacks, so that they are not in the way of the players or conferees, and so that they will not be knocked over and spilled. Whereas it may be possible to have an attachment to the table for this purpose, if the table is of a foldable type, it is desirable to have an attachment which is not in the way when the table is folded and stored.

SUMMARY OF THE INVENTION

It is, therefore, a principal object of this invention to provide a convenient place on which to deposit bowls, ashtrays and other items often used when people are seated at a foldable card table or the like.

Another object of the invention is to provide a device for accommodating such items which attaches to the card table when in use, and is readily stowed away or folded with the card table for storage.

These and other objects are realized in accordance with the present invention in a device which consists of a supporting member including a tongue portion which is designed to be interposed between the surface of the folding table and the frame to form a secure and rigid attachment which functions in cantilevered fashion to support a tray portion which extends out laterally from the supporting member at the edge of the table during use.

In a preferred embodiment, the supporting member and the tray portion are integrally formed from a single rigid plate, the inner end of which takes the form of a flat rectangular tongue which is constructed to slip into and engage a narrow clearance between the rigid surface covering of the table and a lateral frame of the table top, and the tray portion which comprises a semicircular or semielliptical surface surrounded by a knurled edge to accommodate plates and glasses. Preferably, the embodiment in the form of a one-piece plate attachment is constructed to fit into and extend out laterally from the corner of the folding table. This may be formed of a thin plate of any rigid material, such as wood, metal or plastic, preferably a plastic material characterized by a high rigidity, good impact resistance and high flexural modulus. The edging is preferably of wood or plastic. When not in use, the one-piece plate attachment is disengaged from the external edge of the table and stored underneath by slipping the tongue under a strut or crosspiece.

In view of the fact that in some types of folding card tables the surface covering is bolted, screwed or otherwise bonded to the frame member at the corners, an alternative embodiment is provided in which the tongue has a central slot which is constructed to engage and surround a bolt or other obstacle.

In accordance with an alternative form of the invention, the flat rectangular tongue portion is fastened at its external edges to a hinge constructed to support a tray which extends out from the table edge. The hinge is fastened to the face of a downwardly depending flange member shaped to fit onto the corner of the table frame. The tray is a flat fan-shaped member, fastened at its small end to the hinge, and having slightly raised edges to prevent dishes from slipping off when the tray is in use. In storage position, the fan-shaped tray is constructed to fold up and rest on the corner surface of the table so that it does not substantially protrude when the table is folded up. This embodiment can be made of any rigid material, including wood, metal or plastic, preferably any of the plastic materials disclosed with reference to the one-piece plate attachment, such as, for example, an acrylic resin or plastic manufactured by E. I. duPont de Nemours & Co. under the trademark "LUCITE".

A particular feature of the trays of the present invention is that they are designed to accommodate drinks, snack bowls, ashtrays, etc., and poker chips and other game pieces, out of the way of the playing or working surface. The tray device is designed to attach or detach in seconds without the use of tools, screws, adhesives, bolts or brackets. The attachment can be designed to fit any size of folding table and to be stored with the folded table, so as not to substantially protrude or interfere with the normal folding operations of the table.

The invention will be better understood from a study of the specification and claims hereinafter.

BRIEF DESCRIPTION OF THE DRAWINGS

FIGS. 4 and 5 show a modification of the one-piece tray embodiment of the invention, including a slotted tongue and semicircular tray surface right side up and upside down;

FIG. 6 shows the one-piece tray embodiment of FIGS. 2 and 3 in storage position;

DETAILED DESCRIPTION

Figure 1:
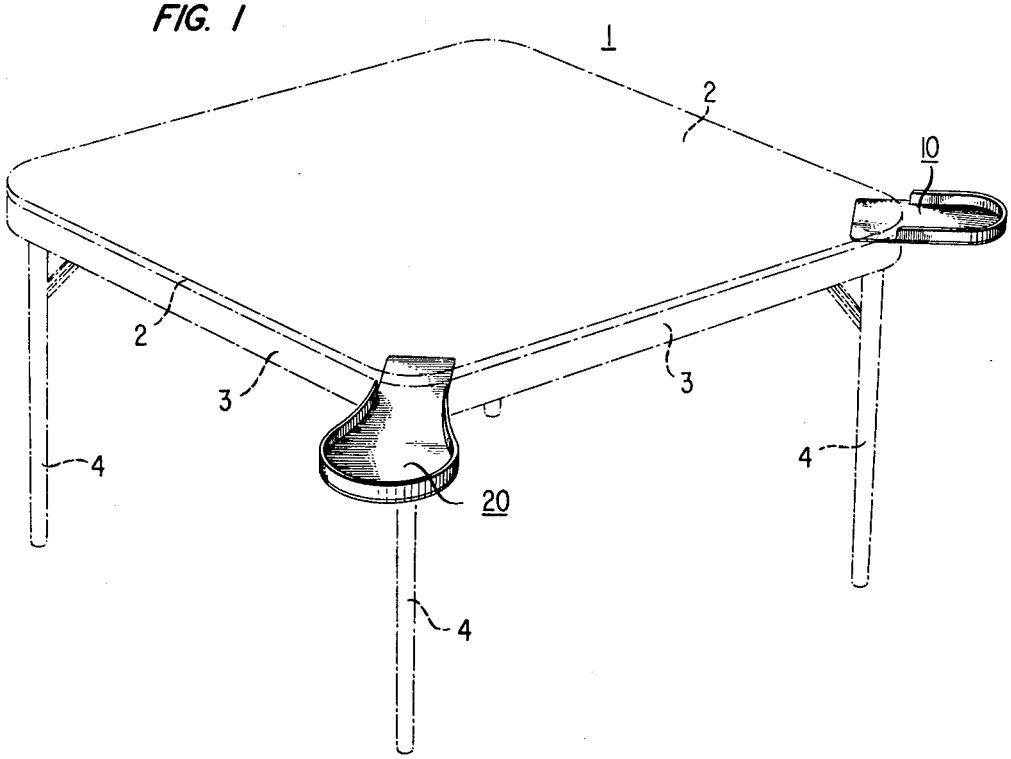
FIG. 1 shows two different embodiments of the invention installed in operative positions on corners of a card table.

Referring to FIG. 1 of the drawings, there is shown a conventional type of foldable card table 1 having a top surface 2 comprising a 34-inch square of, say, a vinyl plastic covering, supported on a rectangular tubular steel frame having sides 3 and legs 4. The foldable card table 1 may be, for example, of any of the types well-known in the art, such as the types manufactured under the trademark "SAMSONITE" and listed in the 1975 catalog of Arthur's Jewelers and Distributors, 149 E. Front Street, Plainfield, New Jersey, on page 297B under catalog numbers 2946-014-4H, 2946-013-6H, 2682-041-5H or 2946-025-0H. A salient feature of the folding table of the type to which the present invention may be applied is that it has a slight clearance at the edges between the table cover and the supporting frame.

Supported on each of two corners of a folding table of the type described are two different embodiments 10 and 20 of the present invention in their operated positions, in which they serve as tray attachments for drinks, snacks, etc.

Figure 2:
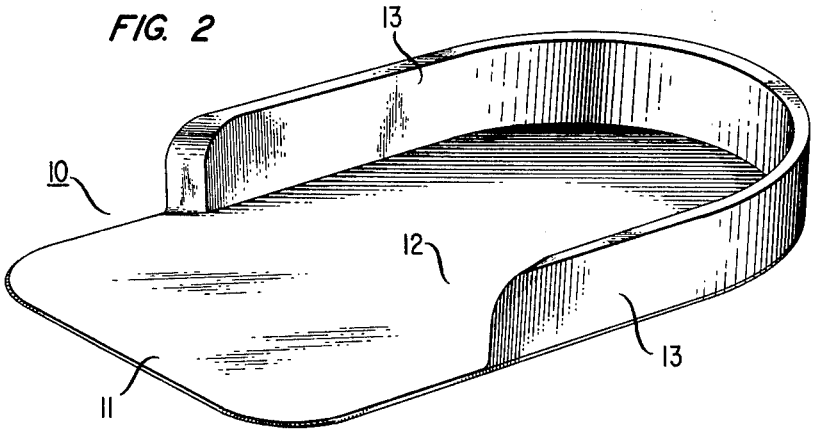
FIGS. 2 and 3 show enlargements of the one-piece tray embodiment of the invention, right side up and upside down, respectively.
Figure 3:
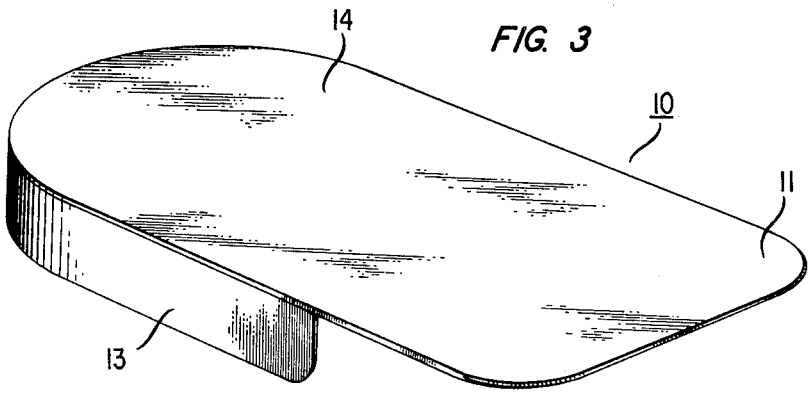

Embodiment 10, shown in enlarged detail in FIGS. 2 and 3, comprises a sheet of any rigid material, such as wood, metal or plastic, and preferably, as previously stated, a plastic material of high rigidity, good impact resistance and a high flexural modulus, of at least about, say, $2.5 \times 10^5$ pounds per square inch. In the example under description, this may comprise, for example, a sheet of acrylonitrile butadiene styrene (ABS) or a polycarbonate material, 0.0625 inch thick. Alternatively, a sheet of glass fiber, reinforced fiberboard can be used. This is cut in one flat piece having an overall length of 8½ inches and an overall width of 4.8 inches. One end, comprising the tray portion 12, is rounded, having a radius of 2.4 inches. The other end 11, comprising the tongue, is substantially rectangular, except for the corners which are slightly rounded, with a radius of curvature of one inch. An edge member 13, which is disposed adjacent the outer periphery of the tray has its terminal ends 2.65 inches back from the straight inner edge of the tongue 11. Edge member 13 may be integrally molded with the flat portions 11, 12 out of plastic. Alternatively, as in the present illustration, it may comprise a narrow wooden flange, 0.8 inch high and 0.28 inch thick, which is bonded to the peripheral edge of tray portion 12. For convenience, the terminal ends of member 13 adjacent the tongue portion 11 are inwardly bevelled at an angle of 45° in a horizontal plane; and the upper edge is slightly rounded in the vertical plane to improve the appearance and remove any sharp edges or corners.

Figure 12:
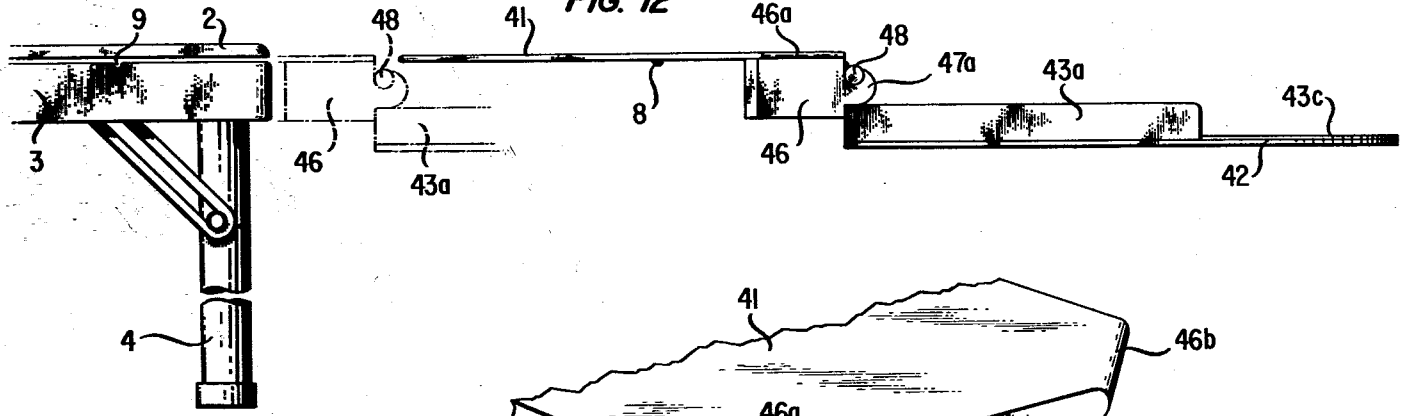
FIG. 12 is a side view of the embodiment of FIG. 9, showing the tongue being interposed into the clearance between the cover and frame of a conventional type of folding table.

The leading edge of tongue 11 is tapered; and as shown in FIG. 3, the underside 14 is preferably perfectly plane to facilitate slidable engagement with table 1, as will be explained hereinafter. Alternatively, it may comprise a small boss or projection for locking purposes, as explained with reference to FIG. 12.

The one-piece embodiment shown in FIGS. 4 and 5 is substantially similar in material and construction to the embodiment of FIG. 2, except that the lateral edges, instead of being straight, are outwardly flared to provide a larger tray space 22; and the tongue 21 is slotted to accommodate bolts or other obstacles which may be present at the corners of table 1 or other edge section where it is desired to attach the tray.

The modified embodiment 20 is larger than the previously described embodiment, being 11.325 inches long, 4.8 inches wide at the leading edge of tongue 21, and 7.25 inches wide at the maximum width of tray portion 22. The rear of tray portion 22 has a radius of curvature of 3.625 inches, from which the edges extend inwardly in a tangential direction to join the straight edges of rectangular tongue portion 21. As in the previous embodiment, an edging member 23 is disposed adjacent the periphery of the tray portion 22, terminating on each side 2.5 inches back from the straight leading edge of tongue 21. As in the previously described embodiment, the latter may be of plastic, integrally molded with the flat plate 22 to form a continuous surface; or, alternatively, may comprise a wooden flange, as in the present example. This is 0.4 inch wide and 0.8 inch high, the inner ends being inwardly bevelled at angles of 45° in a horizontal plane; and the upper edges being curved on a radius of curvature of one-half inch.

A particular feature of this embodiment is a slot 25, centered in the leading edge of tongue 21, which slot is, say, one-half inch wide and about 2.5 inches along the central axis, being curved at its inner end. The function of this slot, as previously stated, is to avoid contact with bolts and other obstacles between the cover 2 and the frame 3, when the device is interposed into the edge of table 1.

FIG. 6 shows the embodiment of FIG. 1 removed from its use position at the edge of the table and upended for storage by interposing tongue 11 behind a bracket or strut on the underside of the table 1.

Figure 7:
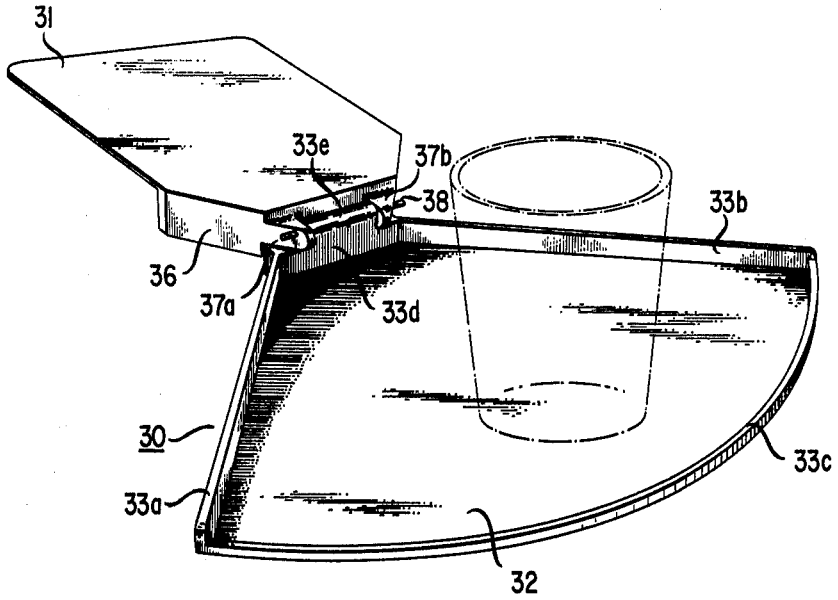
FIG. 7 shows, in operated position, a modified hinged embodiment of the invention in which a pin is used to couple the tray to the tongue bracket.

FIG. 7 of the drawings shows a modification of the device of the present invention, which may be formed of any rigid material, such as wood, metal or plastic or the like. In preferred form, it is made of a plastic material having high rigidity, good impact resistance and a high flexural modulus, such as acrylonitrile butadiene styrene, or a well-known polycarbonate material. In the present example, the base portions of this device are formed from a 3/32 inch thick plate of an acrylic resin sold by E. I. duPont de Nemours & Co. under the trademark "LUCITE". The tongue portion 31 is 6 inches long and 4¾ inches wide, being substantially rectangular at the leading edge except for slightly rounded corners. Beginning 4¾ inches back from the leading edge, opposite edges of tongue 31 are inwardly bevelled at angles of substantially 45°, the bevelled edges each extending about 1¼ inches in a lateral plane, and the rear edge, adjoining the bevelled edges, extending about 2½ inches parallel to the leading edge in the same plane. Rigidly bonded in a rectangular manner to the underside of tongue 31 is a flange member 36, extending ⅞ inch in a vertical plane. Flanged member 36 has an inner concave perimeter with a radius of curvature of 3 9/16 inches. The outer surface of flanged member 36 conforms in a lateral plane to the end shape of tongue 31, except that a pair of hinge terminals **37*a*, 37*b* protrude laterally from the front end. These contain horizontally aligned bores, say, 3/32 inch in diameter, centered about ¼ inch out from the external face of flange member 36 and one-half inch down from the upper surface of tongue 31**.

In operated position, as shown in FIG. 7, the tray is formed of a flat, fan-shaped member having an upper surface 32 and under surface 34, which in the present embodiment is "LUCITE", 3/32 inch thick, although, as previously stated, this may be of any rigid material, such as wood, metal or other suitable plastic. Under surface 34 has a straight inner edge 2½ inches wide, which forms a junction with edge **33*d*. The width of surface 34** broadens out to form an arc having a radius of curvature of about 9¾ inches, the maximum width along the central axis being 9 inches, and along the sides, being 8½ inches, each.

Conforming to the curved edge of upper tray surface 32 is a small ledge **33*c* about ⅜ inch wide and 3/32 inch high above the surface. Edge walls 33*a* and 33*b*, each 7⅜ inches long, ½ inch high and 5/32 inch thick, are bonded flush with the lateral edges of upper surface 32, and are chamfered at their inner ends to fit in bonded relation to the ends of block 33*d*. The latter is in the form of a parallel-piped, 2½ inches long, ⅜ inch wide and ½ inch high, and is bonded flush with the short inner edge of fan-shaped surface 32. Integral with and centered along the upper edge of block 33***d* is a projection 33*e*, 1½ inches long, ⅜ inch wide and about ½ inch high, being rounded along the top edge. This has a substantially axial bore in which is mounted a pin 38 which is, say, 3/32 inch in diameter, and protrudes about ⅛ inch at each end, the ends being accommodated in fixed relation in the bores of hinge terminals 37*a*, 37*b*. The pin 38 is rotatable in the bore provided in 33*e*. This provides a hinge in which rotation of the tray member in a clockwise direction is stopped when the upper rear edge of block 33*d* engages the front face of member 36, thereby holding the tray so that surface 32 is maintained in a substantially horizontal plane.

Figure 8:
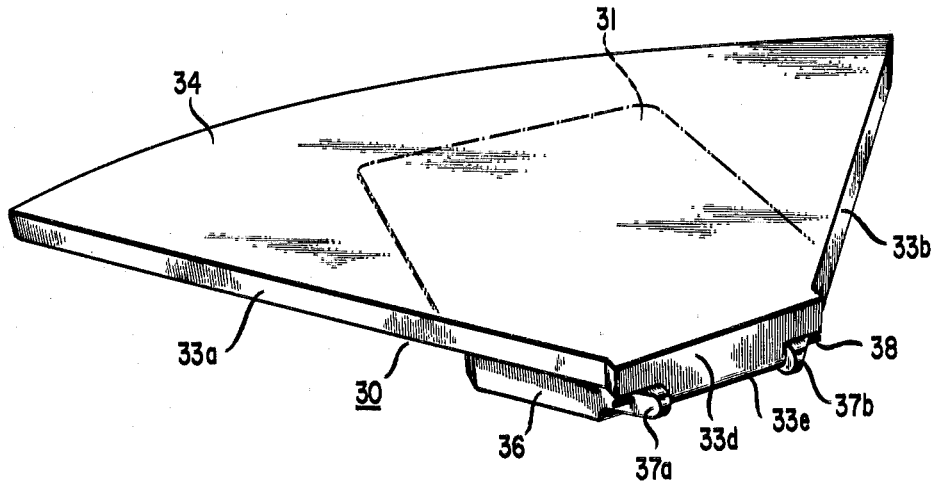
FIG. 8 shows the embodiment of FIG. 7 in storage position.

For storage purposes, as shown in FIG. 8, the tray portion is rotated counterclockwise about the hinge, so that the inner faces of edge members 33*a* and 33*b* fit over the corresponding angular lateral faces of 36; and surface 32 rests on the upper surface of table 1 in substantially parallel relation to the principal surface of tongue 31.

Figure 9:
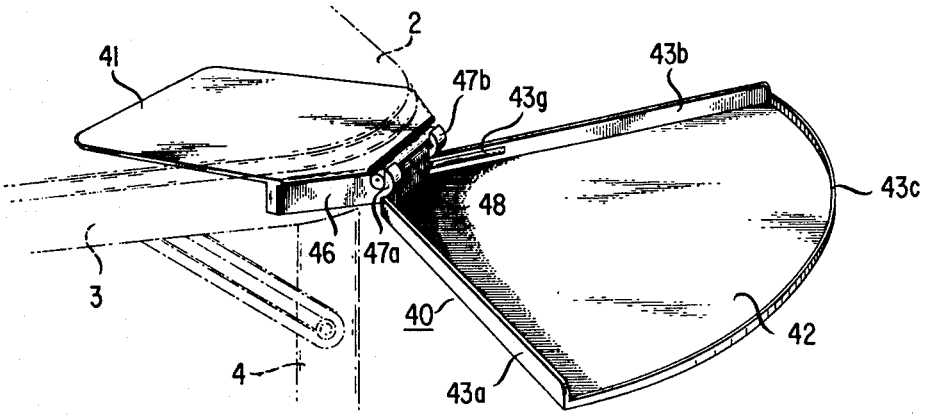
FIG. 9 shows, in operated position, a variation of the embodiment of FIG. 7, in which hooked members and a dowel are integrally formed with the components to provide a hinge between the supporting tongue and the tray.
Figure 10:
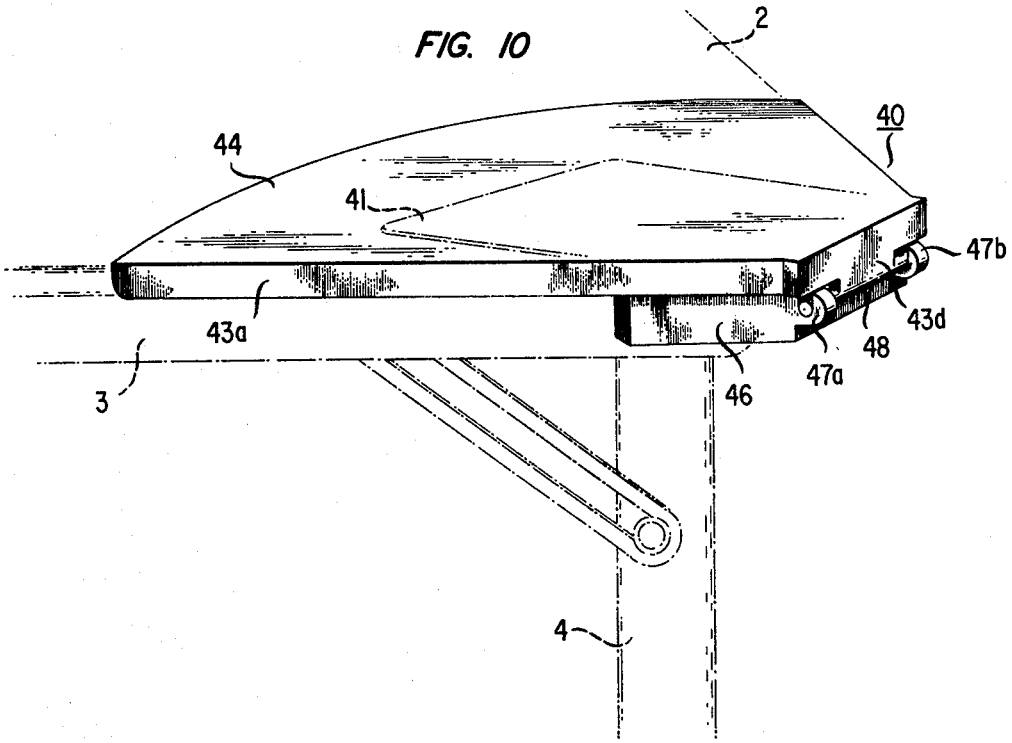
FIG. 10 shows the embodiment of FIG. 9 in storage position.
Figure 11:
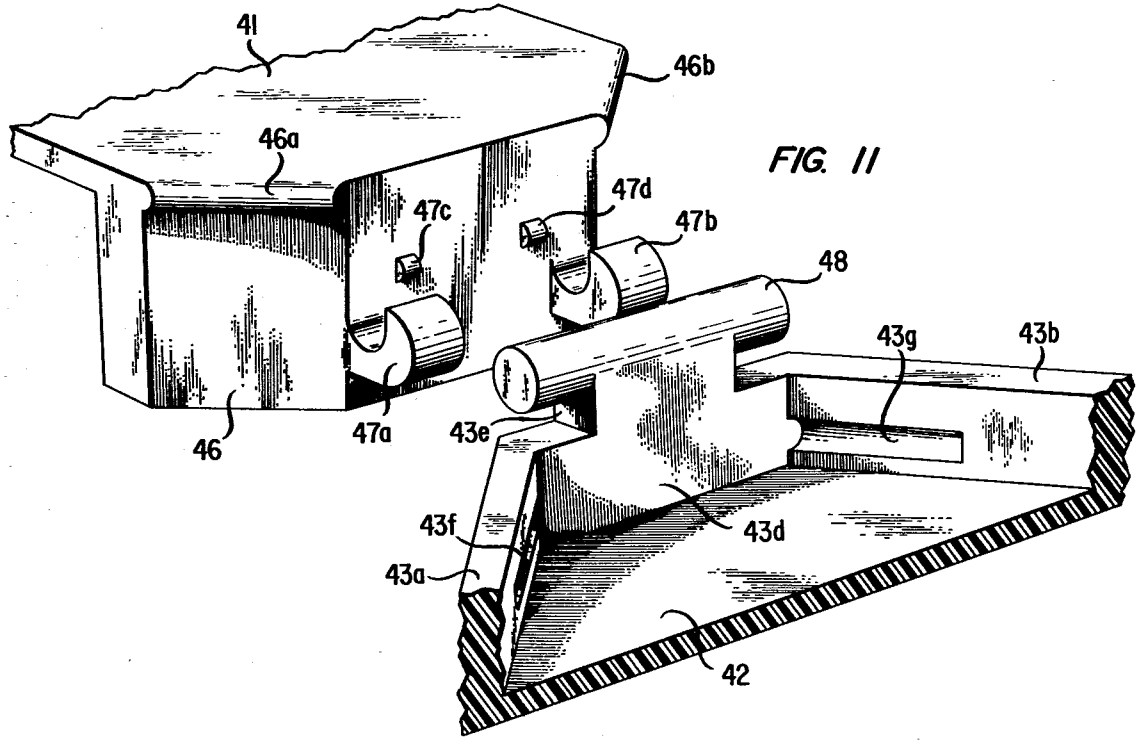
FIG. 11 is an enlarged detailed showing of the hinge arrangement of FIGS. 9 and 10.

A modification 40 of the embodiment 30 of FIGS. 7 and 8 is shown in FIGS. 9, 10 and 11, in which the primary difference between the two embodiments is in the arrangements for the hinge. In the embodiments of FIGS. 9 et seq., it will be understood that reference numbers having similar digits designate corresponding parts, which will not be redescribed except to point out differences. For example, the tongue 41 corresponds to and is substantially similar in material and construction to tongue 31.

The hinge terminals 37*a*, 37*b*, with closed bores, shown in FIGS. 7 and 8, have been replaced in the embodiment shown in FIGS. 9 and 10 by a pair of hooks 47*a* and 47*b*. As shown in enlarged detail in FIG. 11, the projection 43*e* on top of block 43*d* supports a dowel member 48, which is, say, 2½ inches long and, say, ⅜ inch in diameter; and is shaped to be accommodated rotatably on the semicylindrical inner surfaces of hooks 47*a*, 47*b*. A pair of small semicylindrical bosses 47*c* and 47*d* are positioned above each of hooks 47*a* and 47*b* to retain dowel 48 in rotatable position against the concave inner surfaces of hooks 47*a*, 47*b*. The sizes and positions of hooks 47*a*, 47*b* and of bosses 47*c* and 47*d* are so chosen as to permit dowel 48 to be snapped into rotatable position.

In accordance with another alternative, the upper edges of end surfaces 46 may be supplied with a pair of horizontally extending ridges 46*a* and 46*b*. When the tray surface 42 folds over in storage position to rest on the top of table 1, or when the same is being transported, ridges 46*a*, 46*b* engage and latch in slots 43*f* and 43*g*, in the inner sidewalls 43*a* and 43*b*.

PRINCIPLE OF OPERATION

Conventional folding tables, such as bridge table 1 of FIG. 1, consist of a rectangular metal frame 3, a playing surface 2 and folding legs 4. The playing surface 2 usually attaches to the frame by means of screws and brackets which have not been shown.

Generally the playing surface 2 has enough natural compliance to permit a thin plate (approximately 1/16 inch or 3/32 inch thick), such as any of tongues 11, 21, 31 or 41 of the embodiments of FIGS. 2, 4, 7 and 9, hereinbefore described, to be inserted between it and the metal frame 3. This feature is exploited in the design of the table tray attachment of the present invention. The attachment tongue 11, 21, 31 or 41 comprises a thin plate which has surfaces, ridges, contours and protrusions which enhance its coupling to the table, and permits the tray to be attached to the tongue and supported in cantilever fashion in the manner specifically shown in FIG. 12. This figure includes a sectional showing of the attachment of one of the embodiments of the present invention being interposed in operative position between the frame 3 and playing surface 2 of a foldable card table 1 which has been set up in operated position with the legs 4 extended. This is carried out by interposing the tongue 11, 21, 31 or 41 of any one of the embodiments described hereinbefore horizontally between the two members 2 and 3. As a further alternative, the undersides of any one of the tongues referred to may include a locking ridge or button 8 which is positioned during insertion to override a stop 9 just inside the edge of table frame member 3, tending to engage and lock with the same to inhibit the extraction of the tongue when the latter is fully inserted, thereby making a more secure attachment. However, the presence of this feature is not deemed essential to the operation of the combination.

Although the device of the present invention has been described as attaching to a corner of a conventional folding table 1, it will be understood that the embodiments of FIGS. 2 and 4 are also adapted to be attached to the side of a conventional table; and with slight modifications, the embodiments of FIGS. 7 and 9 can be so adapted. In this mode of attachment, the locking members 8 and 9 may be especially helpful.

The device of the present invention is seen to be easily installed and removed without the need of special tools and without physically altering the table. No holes need be drilled into the table nor is there a necessity for using bonding agents or clamps which may mar the table. Further, the device of the present invention does not interfere with the folding action of the legs and conforms essentially to the profile of the table. This feature eliminates any need to remove the device when the table is to be stored. Inasmuch as the device of the present invention is stored with the table, set-up and tear-down times are reduced, the device per se does not require storage space and the device is not likely to be misplaced.

Although the invention has been described with reference to several specific embodiments, it will be understood that the invention is not limited to any of the particular forms shown by way of example, but only by the scope of the appended claims.

What is claimed is:

1. An attachment for use with any conventional foldable table which is characterized by a compliant cover mounted on a rigid supporting frame member, said attachment comprising in combination:

a tongue comprising a member not exceeding about 3/32 inch in thickness and having a flexural modulus of at least about $2.5 \times 10^5$ pounds per square inch, said member having substantially flat parallel major surfaces, a tray connected to at least one edge of said tongue, said tongue being insertable between the compliant cover and the frame of the table thereby deflecting the compliant cover to permit entry of said tongue, the cover, the frame, and said tongue thereby combining to provide support for said tray in outwardly extended cantilevered fashion in a substantially horizontal plane adjacent an edge of the table, thereby to furnish the sole support for said attachment.

2. The combination in accordance with claim 1 wherein said tray is substantially a coplanar unitary extension of said tongue.

3. The combination in accordance with claim 2 wherein said tray in operated position includes an upwardly extended edge flange around its perimeter defining a portion of said extension external to said tongue.

4. The combination in accordance with claim 2 wherein said tongue is substantially rectangular, having a straight bevelled leading edge, and wherein the external end of said tray is rounded in its principal plane.

5. The combination in accordance with claim 4 wherein the external end portion of said tray is semicircular in its principal plane.

6. The combination in accordance with claim 2 wherein the leading edge of said tongue is slotted to accommodate an obstacle interposed between the table cover and the frame.

7. The combination in accordance with claim 1 wherein said tongue includes a boss integrally formed on the underside near the outer portion of said tongue for engaging the frame of the table in locked operated position.

8. The combination in accordance with claim 1 wherein said attachment includes a hinge coupled between said one edge of said tongue and one edge of said tray.

9. The combination in accordance with claim 8 wherein said tray is substantially fan-shaped, being hinged to said tongue at the small end of said fan-shaped tray.

10. The combination in accordance with claim 9 wherein said fan-shaped tray in operated position has a pair of upwardly extended edge flanges and a raised edge defining the arc of the fan-shaped tray.

11. The combination in accordance with claim 10 wherein in storage position said fan-shaped tray is disposed to rotate in a counterclockwise direction on said hinge, and fold over and rest on a corner surface of the table.

12. The combination in accordance with claim 8 wherein said tongue includes a downwardly depending flange member shaped to fit around a corner of the foldable table, hinge supports including bores connected to said flange, said tray including an upwardly extended flange at its inner end including a bore, and a pin mounted in said bore so that the laterally extended ends of said pin are accommodated in fixed relation to said hinge supports.

13. The combination in accordance with claim 8 wherein said hinge includes a pair of hooked members connected in spaced-apart relation adjacent the external edge of said tongue, and one end of said tray includes a dowel, the ends of said dowel being accommodated for rotation in said hooked members.

14. The combination in accordance with claim 13 wherein the end of said tongue adjacent said hinge includes a pair of ridges, and said tray including upwardly extending edge flanges with internal slots for accommodating said ridges when said tray is folded in storage position.

* * * * *

UNITED STATES PATENT OFFICE

CERTIFICATE OF CORRECTION

Patent No. 4,099,470 Dated July 11, 1978

Inventor(s) Thomas C. Cannon, Jr.

It is certified that error appears in the above-identified patent and that said Letters Patent are hereby corrected as shown below:

The term of this patent subsequent to July 11, 1995 has been disclaimed.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*